US006948627B1

(12) United States Patent
Evans

(10) Patent No.: US 6,948,627 B1
(45) Date of Patent: Sep. 27, 2005

(54) SPORTS-HEADGEAR HANGER

(76) Inventor: Earl Evans, 1999 Sweetland Rd., Muscatine, IA (US) 52761

( * ) Notice: Subject to any disclaimer, the term of this patent is extended or adjusted under 35 U.S.C. 154(b) by 0 days.

(21) Appl. No.: 10/446,527

(22) Filed: May 27, 2003

Related U.S. Application Data

(60) Provisional application No. 60/383,410, filed on May 24, 2002.

(51) Int. Cl.[7] ..... A47F 5/08

(52) U.S. Cl. ..... 211/85.7; 211/32; 211/105; 211/87.01

(58) Field of Search ..... 211/105, 85.7, 211/32, 202, 104, 87.01; D6/552

(56) References Cited

U.S. PATENT DOCUMENTS

| | | | | |
|---|---|---|---|---|
| 68,616 | A * | 9/1867 | Everingham | 211/105 |
| 245,897 | A * | 8/1881 | Walters | 211/105 |
| 818,709 | A * | 4/1906 | Reichle | 211/105 |
| 842,940 | A * | 2/1907 | Clark | 211/105 |
| 1,254,508 | A | 1/1918 | Kellar | |
| 2,094,810 | A | 10/1937 | Oppenheimer | |
| 2,709,004 | A | 5/1955 | Dahlstrom | |
| 3,650,407 | A | 3/1972 | Benham, Jr. | |
| 3,698,563 | A | 10/1972 | Gordon et al. | |
| 3,869,137 | A | 3/1975 | Byrom | |
| 3,876,223 | A | 4/1975 | O'Reilly et al | |
| 3,977,521 | A | 8/1976 | Murphy | |
| 4,002,241 | A | 1/1977 | Parrilla, Sr. | |
| 4,049,126 | A | 9/1977 | Halverson | |
| 4,155,553 | A | 5/1979 | Lin | |
| 4,193,495 | A | 3/1980 | Keeley | |
| 4,227,710 | A | 10/1980 | Laub | |
| 4,287,993 | A * | 9/1981 | Licari | 211/105 |
| 4,497,413 | A * | 2/1985 | Tocci | 211/202 |
| 4,583,647 | A | 4/1986 | Schinzing | |
| D283,846 | S | 5/1986 | Wessel | |
| 4,595,226 | A | 6/1986 | Wessel | |
| 4,629,065 | A | 12/1986 | Braaten | |
| 4,793,481 | A | 12/1988 | Randle | |
| 4,793,532 | A | 12/1988 | Cash | |
| 4,854,456 | A | 8/1989 | Lee | |
| 4,890,731 | A | 1/1990 | Mroz | |
| D306,385 | S | 3/1990 | Alexander et al. | |
| 4,936,467 | A | 6/1990 | Bobeczko | |
| D309,226 | S | 7/1990 | Wilcox | |
| D311,565 | S | 10/1990 | Buri, Jr. et al. | |
| 4,968,048 | A | 11/1990 | Lortie | |
| D314,302 | S | 2/1991 | Snow | |
| 5,038,941 | A | 8/1991 | Bastiaansen | |
| D320,325 | S | 10/1991 | Barfield | |
| 5,054,625 | A | 10/1991 | Foley | |
| 5,085,327 | A | 2/1992 | Mercer, Jr. et al. | |

(Continued)

*Primary Examiner*—Robert W. Gibson, Jr.
(74) *Attorney, Agent, or Firm*—Sturm & Fix LLP

(57) ABSTRACT

In baseball and softball, as well as other sports, equipment such as helmets, caps, and ball gloves are worn by the players, but not necessarily throughout the entire duration of a game. When not being worn, this equipment should be organized by hanging it up. However, hooks for hanging equipment are not universally available at all ball diamonds and other sports fields. A scissor-folding hanger made of light material such as PVC pipe and made to hang on a fence provides the needed storage space. Such a hanger is light and folds into a very small package, enhancing its portability. The strength of the rack can be varied by using larger or smaller diameter pipe for its construction. The scissor-folding sports-gear hanger is a flexible solution to the storage needs on the sports-field.

6 Claims, 2 Drawing Sheets

U.S. PATENT DOCUMENTS

| | | | | |
|---|---|---|---|---|
| D335,416 | S | | 5/1993 | Shaw |
| 5,224,602 | A | | 7/1993 | Bettles et al. |
| 5,273,298 | A | | 12/1993 | Brown, Sr. |
| 5,294,005 | A | | 3/1994 | Hedges |
| 5,303,828 | A | | 4/1994 | Paullin |
| 5,335,794 | A | | 8/1994 | Reedy |
| 5,335,956 | A | | 8/1994 | Panossian |
| D353,067 | S | | 12/1994 | Asmar |
| 5,413,228 | A | | 5/1995 | Le Clerc |
| D362,756 | S | | 10/1995 | Finger |
| 5,462,328 | A | | 10/1995 | Chandler et al. |
| D373,498 | S | | 9/1996 | Young |
| 5,566,837 | A | | 10/1996 | Lema |
| 5,626,244 | A | | 5/1997 | Mesna et al. |
| 5,678,698 | A | | 10/1997 | Cabral |
| D390,737 | S | | 2/1998 | Strnad |
| D398,469 | S | * | 9/1998 | Leong et al. ..... D6/552 |
| 5,823,360 | A | | 10/1998 | Gorosave |
| 5,871,105 | A | | 2/1999 | Whitehead et al. |
| 5,904,276 | A | * | 5/1999 | Chen et al. ..... 223/1 |
| 6,053,340 | A | | 4/2000 | Cameron |
| 6,138,841 | A | | 10/2000 | Klein et al. |
| D487,831 | S | * | 3/2004 | Savoie ..... D32/58 |
| 6,749,074 | B1 | * | 6/2004 | Hileman et al. ..... 211/85.7 |

* cited by examiner

SPORTS-HEADGEAR HANGER

CROSS-REFERENCE TO RELATED APPLICATIONS

This application is a continuation of co-pending commonly owned U.S. Provisional Application No. 60/383,410, filed May 24, 2002, entitled Hanger for Softball Helmets. Priority is claimed under 35 U.S.C. §119(e). The contents of the same are expressly incorporated herein by reference.

STATEMENT REGARDING FEDERALLY SPONSORED RESEARCH OR DEVELOPMENT

Not Applicable

AUTHORIZATION PURSUANT TO 37 C.F.R. § 1.71(d)(e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to a collapsing storage rack. More particularly the present invention relates to a scissor-foldable rack with hooks for hanging the same from a vertical support such as a fence, and hooks or protrusions for baseball or softball helmets, baseball caps, ball gloves, etc.

2. Background Art

Helmets and/or caps are worn by the players of such sports as baseball and softball. The players may choose to remove their helmets or caps when they are not needed, such as when awaiting a turn at batting. Because teams play on various diamonds or fields, the facilities vary. In particular, there may or may not be a provision for hanging player's helmets or caps. All equipment is transported to the field or diamond for each game and even for practices. Helmets and caps that are tossed on the ground when not in use experience greater wear, scuffing, and the possibility of being forgotten when compared to those hung on a storage rack.

In U.S. Pat. No. 4,629,065 by Braaten discloses a tubular "baseball equipment holder." This rack is telescopic, having one tube of smaller diameter that slides into a second tube of larger diameter. The rack is hung by S-hooks, and a modified version has S-hooks for hanging the equipment for which the rack is used.

Hedges, in U.S. Pat. No. 5,294,005, discloses a similar, telescoping rack for hanging sports equipment. A variety of hooks can be provided for this rack for hanging various items. Both the racks by Braaten and Hedges require a long space on which to hang the racks, and they are limited in the length to which they can be collapsed. The strength of the telescoping joint may require additional provisions to keep from kinking the racks.

Keeley discloses still another "portable sports equipment organizer" in U.S. Pat. No. 4,193,495. This rack is folding, rather than telescoping, being rectangular in either transport mode or "use" mode, and having handles for ease of transport. The Keeley rack is rather large in transport mode, being only folded in half from its "use" mode. Also, the rigidity required for its intended use will result it a fairly heavy article.

Scissor-folding wooden racks are commonplace in households. However, these racks have not been configured specially to hold sports equipment, nor to hang on a fence such as those found around most baseball and softball diamonds. In particular, wooden pegs are inserted at intervals along each wooden member. Because the greatest spacing between hooks is realized if the hook (or peg) is formed at the ends of the members, the common wooden rack is less than suitable for hanging large, broad objects such as helmets. Furthermore, these wooden racks lack the strength and durability required of a portable sports headgear rack.

There is, therefore, a need for a rack for the purpose of storing caps and helmets. Such a rack must, necessarily, be small and light for ease of transport to and from the field or diamond; while exhibiting significant durability. Because of the required size of a helmet/cap storage rack when in use, there is a need for a rack having the capability to collapse into a small space for transport.

SUMMARY OF THE INVENTION

A purpose of this invention is to provide a method and apparatus for hanging headgear such as that worn by players of various sports. Another purpose of this invention is to provide a portable (both small and light) rack for hanging headgear and other items.

Often, a rack for headgear such as baseball or softball helmets and caps, is not provided at a diamond or field. Yet players may wish (or be required) to wear such headgear for only part of the game; or they may need to switch headgear depending on the stage of the game. When headgear is dropped on the ground or dugout floor, it will, naturally, tend to become scuffed and worn. Furthermore, there is a chance that some of the headgear will be forgotten, depending on where it is dropped. Hanging headgear wherever possible (on fences or poles) is only slightly better than dropping them on the ground.

With the availability of modern-day materials, a rack can be made of commonly available, light, tubular plastic, such as PVC or ABS pipe. Because there are many sizes of PVC and ABS pipe, significant flexibility in size, weight, and strength are available.

To meet the requirement of a small size for transport and storage, members making up a rack are connected so that they fold, scissor-fashion, such that in use, the rack forms a lattice-structure. Except for the outermost members, each member is pivotally connected to three other members using simple threaded connectors. The result is a strong rack that will collapse into a very small space.

Again, using common materials such as PVC or ABS pipe, both ends of the front members (those furthest from the fence) making up the hanger can be formed, using elbows, into hooks or protrusions for hanging sports equipment such as headgear and ball gloves.

To make a sports-headgear hanger useful, it should be hung for easy access. Nearly every ball diamond and many sports fields have a chain-link fence around at least parts of them. Multiple hooks, operably, pivotally attached to some of the members, are provided to hang the rack on a fence or other vertical structure.

The novel features which are believed to be characteristic of this invention, both as to its organization and method of operation together with further objectives and advantages thereto, will be better understood from the following description considered in connection with the accompanying drawings in which a presently preferred embodiment of the invention is illustrated by way of example. It is to be expressly understood however, that the drawings are for the purpose of illustration and description only and not intended as a definition of the limits of the invention.

BEST MODE FOR CARRYING OUT THE INVENTION

Figure 1:
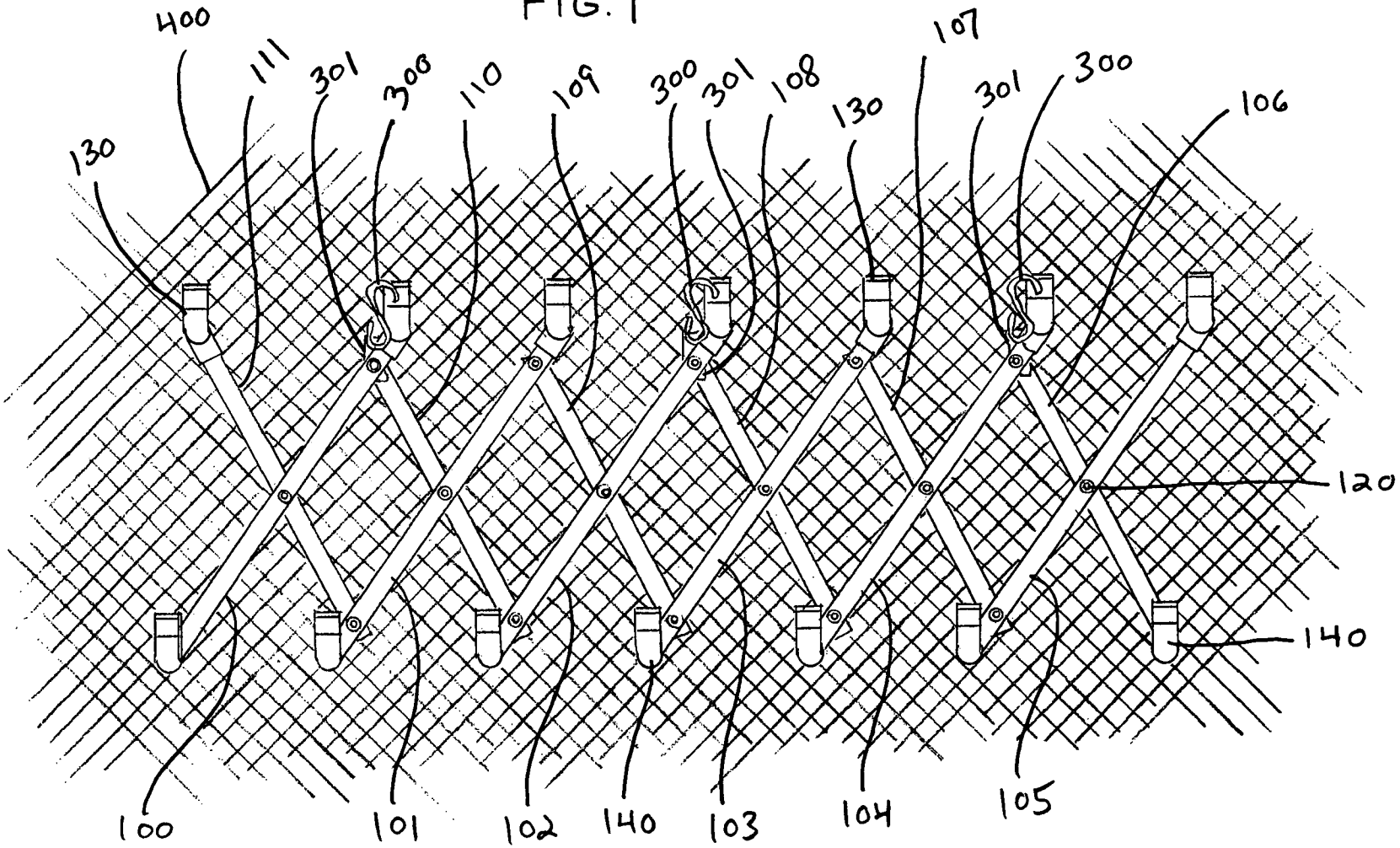
FIG. 1 shows a perspective view of a sports-headgear hanger in the position in which it will be used.

A perspective view of a sports-headgear hanger or rack is shown in FIG. 1. Members 100–112 fold, in scissor fashion, relative to one another. Each of the outside members 100, 105, 106, and 111 are operably, pivotally attached to two other members via threaded fasteners 120. All other members 101–104, 107–110 are operably, pivotally connected to three other members via threaded fasteners 120, such as bolts or machine screws with lock nuts. The rear outer member 111 shown on the left in FIG. 1 has a hook 130 formed on its upper end, while the rear outer member 106 shown on the right has a hook 140 formed on its lower end. The front members 100–105 have hooks 130, 140 formed on their upper and lower ends. The remaining rear members 107–110 have no hooks. All these hooks 130, 140 are provided for hanging sports-headgear or other equipment or garments. When spread in the "in-use" mode or position, the hooks 130, 140 are adequately spaced to provide clearance for the hanging items.

Figure 2:
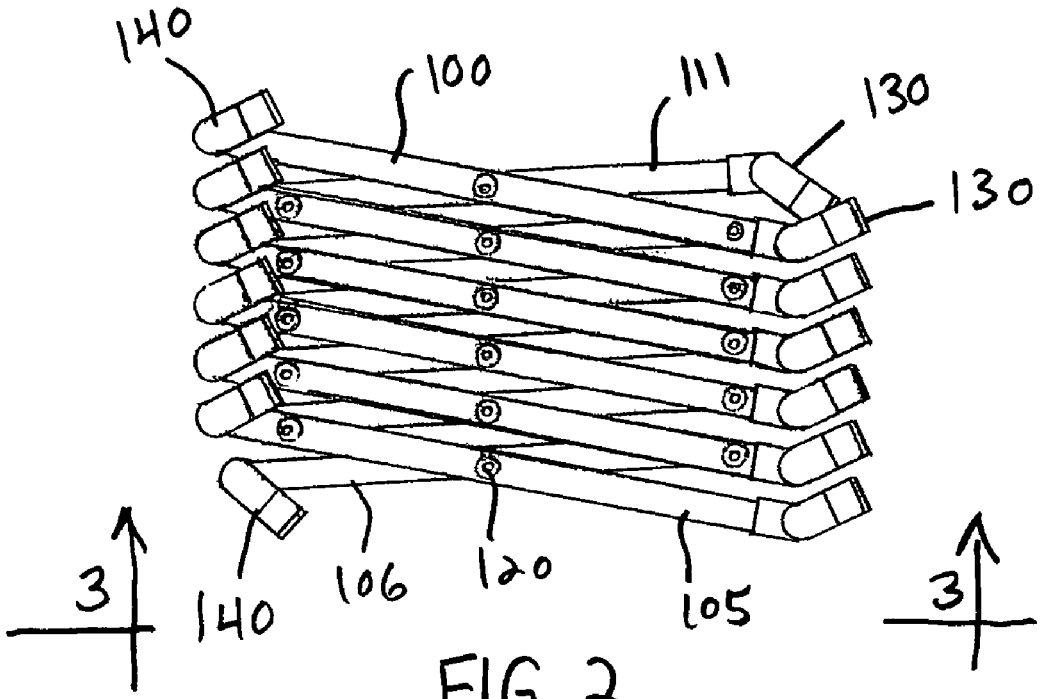
FIG. 2 shows a sports-headgear hanger in its collapsed or transport mode.

The sports-headgear hanger is shown in a collapsed state in FIG. 2. Each member 100–111 pivots on its threaded fasteners 120 to convert from the in-use state shown in FIG. 1 to the collapsed state shown in FIG. 2.

Figure 3:
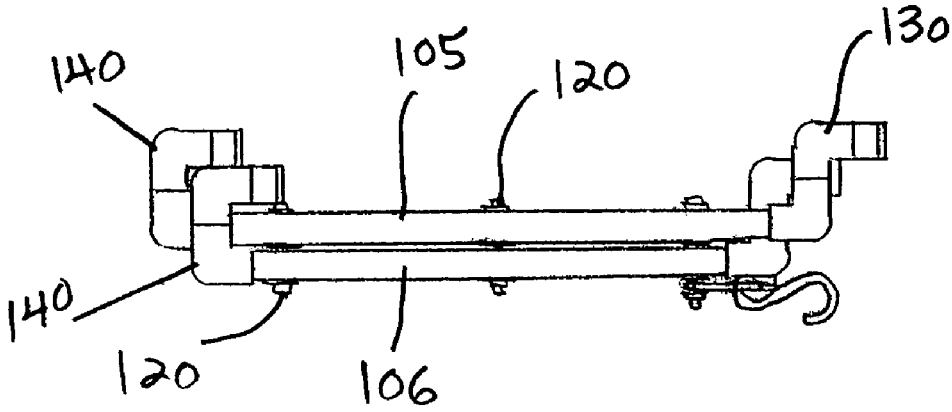
FIG. 3 shows a view of the hooks installed on and used to hang a sports-headgear hanger from a fence or other vertical structure.

An assembly for attaching a hook 300 for hanging the sports-headgear hanger is detailed in FIG. 3. The hooks 300 are operably, pivotally attached to plates 301 pivotally attached in turn to the associated members (two or more of them 100–111) via the threaded fasteners 120. Flat washers are used on each surface of a member 100–111 (with only a single flat washer between members). In the preferred embodiment, a locknut is used to secure the assembly. In additional embodiments, cotter-pins or non-locking nuts are used instead of the locknuts; or rivets are used in place of the threaded fasteners. In still another embodiment, the hooks 300 are operably, pivotally attached to the members via separate fasteners (as outlined above in the various embodiments) than those operably, pivotally connecting the members 100–111. The hooks 300 can be made to engage one another when the sports-headgear hanger is in its collapsed (or transport) state.

In FIG. 1, the sports-headgear hanger is shown in use. Equipment may be hung on the upper hooks 130 and on the lower hooks 140, simultaneously. The sports-headgear hanger is hanging from a fence 400 via the hooks 300 that are operably, pivotally attached to the associated members.

The above describes the preferred embodiment, but this invention is not limited thereto. The hanger is not limited to sports equipment or clothing. The hanger may be hung on many vertical structures, including a stand constructed specifically for that purpose. It may be manufactured of materials other than tubing and other than PVC or ABS plastics. Many fastener systems may be used. It has, therefore, been shown that many modifications and variations of the present invention are possible in light of the above teachings. It is, therefore, to be understood that within the scope of the appended claims, the invention may be practiced otherwise than as specifically described.

What is claimed is:

1. An apparatus for providing collapsible hanger space comprising:

a plurality of members, operably, pivotally attached to one to another so they fold in scissor-fashion;

a hook formed on at least one end of at least one of said plurality of members; and second hooks coupled to said plurality of members and movable between positions of mutual engagement to secure the collapsible hanger space in collapsed form and positions of disengagement for hanging the collapsible hanger from a vertical structure.

2. The apparatus of claim 1 wherein the second hooks for hanging the collapsible hanger are S-hooks.

3. The apparatus of claim 1 additionally comprising threaded fasteners with which to pivotally attach the second hooks for hanging the collapsible hanger.

4. A method for providing a collapsible hanger, the method comprising:

operably, pivotally attaching a plurality of members one to another so they fold in scissor-fashion;

forming a hook on at least one end of at least one of said plurality of members, and wherein hooks for hanging the collapsible hanger from a vertical structure are operably attached to some of said members and moveable between a position of mutual engagement to secure the collapsible hanger in collapsed position and a position of mutual disengagement to enable hanging from a vertical structure.

5. The method of claim 4 wherein the hooks for hanging the collapsible hanger are S-hooks.

6. The method of claim 4 wherein the hooks for hanging the collapsible hanger are operably, pivotally attached with threaded fasteners.

* * * * *